US008071013B2

(12) United States Patent
Niehoff et al.

(10) Patent No.: US 8,071,013 B2
(45) Date of Patent: Dec. 6, 2011

(54) MELTING STARTING MATERIAL IN A CUPOLA FURNACE

(75) Inventors: Thomas Niehoff, Markt Indersdorf (DE); Peter Kokas, Budapest (HU)

(73) Assignee: Linde Aktiengesellschaft (DE)

( * ) Notice: Subject to any disclaimer, the term of this patent is extended or adjusted under 35 U.S.C. 154(b) by 0 days.

(21) Appl. No.: 12/683,594

(22) Filed: Jan. 7, 2010

(65) Prior Publication Data

US 2010/0186552 A1 Jul. 29, 2010

(30) Foreign Application Priority Data

Jan. 29, 2009 (DE) ..... 10 2009 006 573

(51) Int. Cl.
*C21B 13/02* (2006.01)
*C21B 7/00* (2006.01)

(52) U.S. Cl. ..... 266/197; 266/44; 266/217; 266/225

(58) Field of Classification Search ..... 266/225, 266/44, 197, 217
See application file for complete search history.

(56) References Cited

U.S. PATENT DOCUMENTS

| | | | | |
|---|---|---|---|---|
| 3,547,624 | A | 12/1970 | Gray | |
| 3,958,919 | A * | 5/1976 | Kjell-Berger | 432/14 |
| 4,691,899 | A * | 9/1987 | Hayashi et al. | 266/140 |
| 5,346,183 | A * | 9/1994 | Westley | 266/197 |

FOREIGN PATENT DOCUMENTS

| | | | |
|---|---|---|---|
| EP | 0 762 068 | A1 | 3/1997 |
| EP | 0 793 071 | A2 | 9/1997 |
| EP | 1 325 950 | A2 | 7/2003 |
| EP | 1 997 915 | A1 | 12/2008 |

OTHER PUBLICATIONS

European Search Report, May 19, 2009.

* cited by examiner

*Primary Examiner* — George Wyszomierski
*Assistant Examiner* — Tima M McGuthry Banks
(74) *Attorney, Agent, or Firm* — Joshua L. Cohen

(57) ABSTRACT

The invention relates to operating a shaft furnace, in particular a cupola furnace, for melting starting material, wherein the shaft furnace is heated by combustion of a solid fuel and wherein an injection gas, which has an oxygen portion of more than 21%, is injected into the shaft furnace. The shaft furnace is heated by means of at least one burner, wherein a gaseous or liquid fuel and a gaseous oxidant, which encompasses an oxygen portion of more than 21%, is supplied to the burner.

8 Claims, 1 Drawing Sheet

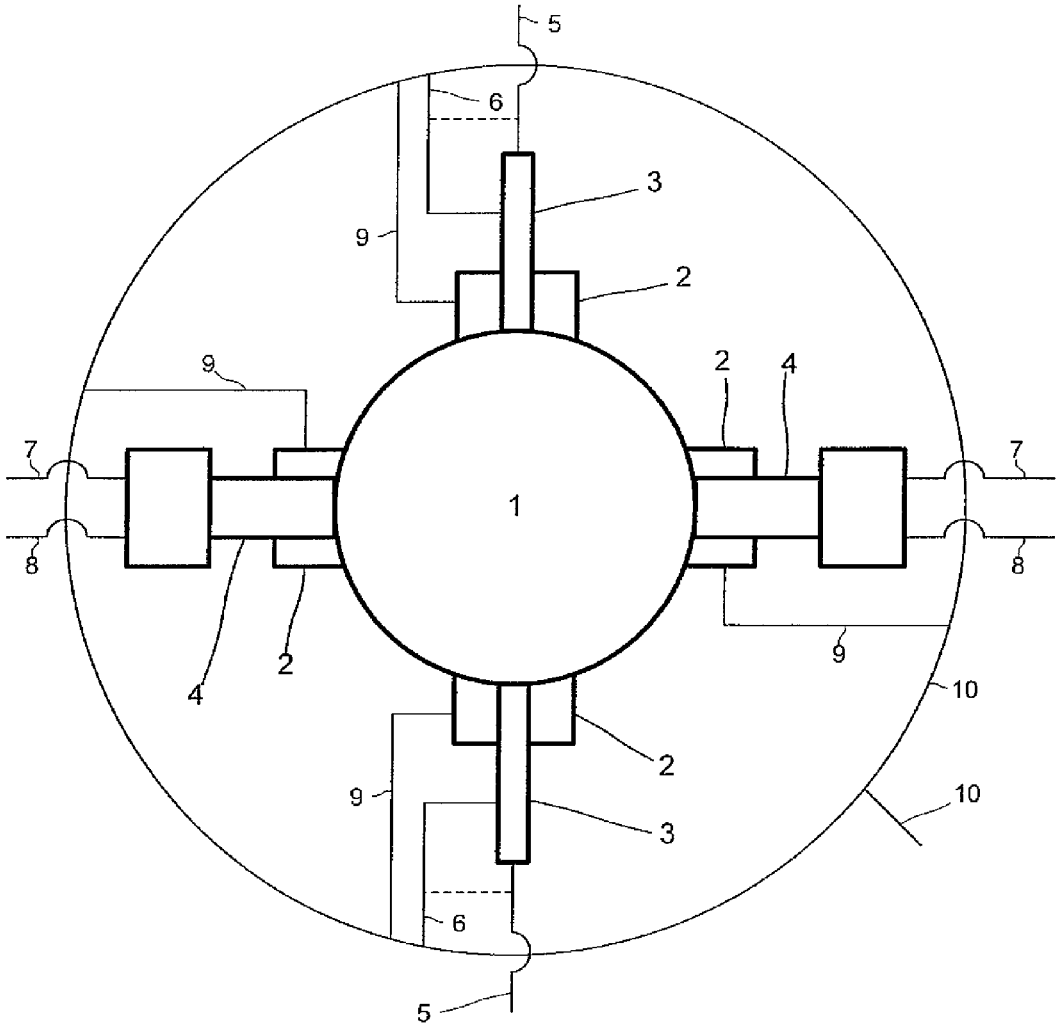
5
6
3
9
2
9
2
4
7
7
1
8
8
4
2
9
10
2
9
10
3
6
5

MELTING STARTING MATERIAL IN A CUPOLA FURNACE

The invention relates to a method for operating a shaft furnace, in particular a cupola furnace, for melting starting material, and a shaft furnace, in particular a cupola furnace, for melting the starting material.

In a cupola furnace, an iron batch, which mostly consists of pig iron, cast iron scrap, scrap steel and other ferro alloys, is melted. Foundry coke, which is combusted by means of a reaction with oxygen and which thereby releases the amount of energy, which is required for melting the iron batch, is typically used as fuel in the cupola furnace.

Originally, coke was combusted with air as oxidant. In the meantime, however, the use of oxygen-enriched air is considered to be the technical standard for melting in the cupola furnace. The advantage as compared to the use of air is that higher combustion temperatures can be generated and that the melting process runs faster.

EP 0 762 068 A1 discloses a method for supplying combustion air into a cupola furnace, in the case of which oxygen is injected into the cupola furnace and the low pressure generated thereby is used to suck further combustion air into the cupola furnace.

On the one hand, the coke serves as fuel in the cupola furnace, on the other hand it serves for the carbonization of the liquid iron. In the event that the above-described oxygen injection is used, the coke in the cupola furnace is combusted more rapidly by means of the additional oxygen. The thus reduced quantity of coke, however, has a negative impact on the carbonization of the liquid iron.

It is thus the object of the instant invention to present an improved method for operating a shaft furnace of the aforementioned type and a corresponding shaft furnace.

This object is solved by means of a method for operating a shaft furnace, in particular a cupola furnace, for melting starting material, wherein the shaft furnace is heated by combustion of a solid fuel and wherein an injection gas, which has an oxygen portion of more than 21%, is injected into the shaft furnace, and wherein the method is characterized in that the shaft furnace is heated by means of at least one burner, wherein a gaseous or liquid fuel and a gaseous oxidant, which encompasses an oxygen portion of more than 21%, are supplied to the burner.

The shaft furnace according to the invention, in particular the cupola furnace, for melting a starting material, has a feed line for an oxygen-containing injection gas, at the downstream end of which a driving nozzle is connected, wherein an injector blast pipe empties into the feed line for the oxygen-containing gas or into the driving nozzle, and wherein the shaft furnace encompasses at least one burner, which is provided with a feed line for a gaseous oxidant and with a feed line for a liquid or gaseous fuel.

The term "shaft furnace" refers in particular to a cupola furnace, in particular to a cupola furnace for melting cast iron and spheroidal cast iron. However, other shaft furnace systems for melting other metallic starters such as copper or aluminum for example, or also for melting non-metallic materials for example, for creating mineral wool can be operated according to the invention.

Accordingly, the term "starting material" is to comprise metal-containing and non-metallic batches, which are supplied to a cupola furnace for melting. As already mentioned above, the so-called iron batch or cold batch, consisting of pig iron, cast iron scrap, scrap steel and/or other iron-containing additives, is included herein. However, depending on the type of shaft furnace, copper-containing or aluminum-containing or non-metallic batches are also possible as starter material.

In the context of this application, the terms "blast", "residual blast" and "injector blast" refer to oxygen-containing gas flows, which are fed to the shaft furnace, in particular air flows, which are fed under increased pressure.

The term "injection gas" refers to an oxygen-containing gas flow, which is introduced into the shaft furnace via a lance, a pipe, a driving nozzle or the like. Contrary to a burner, the injection gas is fed to the shaft furnace without a reaction partner. The injection gas first reacts with the solid and liquid substances located in the shaft furnace as well as with the atmosphere in the shaft furnace. However, it is also possible to introduce the injection gas into the shaft furnace together with other substances or liquids, with which the injection gas does not react, under the conditions prevailing in the lance or nozzle.

The term "oxygen burner" hereinbelow refers to a burner, which is operated with a liquid or gaseous fuel and with an oxygen-containing gas, which has an oxygen concentration of more than 21%. In particular, pure oxygen or technically pure oxygen, respectively, or oxygen-enriched air is used as oxidant.

According to the invention, the aforedescribed technology of oxygen injection into the cupola furnace was further developed to the effect that oxygen burners are additionally used for melting. The use of oxygen burners in cupola furnaces per se is already known. For example, the use of oxygen-fuel-burners in shaft furnaces is described in German patent application DE 1 583 213 OS. The combination according to the invention of the two technologies, which are in each case known per se, however, show surprising advantages.

According to the invention, the two technologies of the oxygen injection and of the heating by means of burners in a shaft furnace are combined, thus mostly avoiding the respective disadvantages and attaining a considerable improvement of the melting method. In the case of the pure oxygen injection, there is thus the danger that the coke burns off too quickly. Contrary thereto, in the case of the use of oxygen burners, the combustion gases, in particular water vapor and carbon dioxide as well as unburnt fuel can cause an undesired cooling effect in the shaft furnace. The use of both technologies according to the invention avoids these disadvantages and allows for a greater flexibility in the process.

According to the invention, the melting process in the shaft furnace can be controlled via the coke quantity, the quantities of liquid or gaseous fuel and the supplied quantity of oxygen-containing injection gas. For example, the stoichiometry in the shaft furnace can be controlled by a corresponding adjustment of these parameters, that is, a reducing or neutral atmosphere can be adjusted, for example. In the case of the melting processes with oxygen injection known from the state of the art, there is a danger of an atmosphere, which oxidizes too much when the melting process is accelerated by means of oxygen injection. According to the invention, this danger is handled in that the melt power is not only controlled via the oxygen injection, but in particular also via the burner power.

The coke combustion and thus the carbonization of the molten iron in the shaft furnace can be optimized by means of supplying the oxygen-containing injection gas. Secondary reactions, for example endothermic reactions of excessive fuel comprising components of the furnace atmosphere, for example, are influenced by means of the additional oxygen in the shaft furnace.

The energy required for melting the starting material is no longer supplied only via the coke, but additionally via the burners. In so doing, the melting power can be optimized and/or the coke quantity can be reduced.

Preferably, the injection gas is injected into the shaft furnace at a relatively "cold" location. The temperature in the shaft furnace is a function of the height, that is, different temperatures prevail at different heights. Accordingly, a "cold location" is a location in the shaft furnace at which the temperature is lower than the average temperature at this furnace height.

Vice versa, the burners are preferably directed to "hot" furnace areas at which the temperature is higher than the average temperature at this furnace or shaft height, respectively.

In cupola furnace operation, an uneven thermal stress often occurs across the furnace periphery. This can be seen, for example, in an uneven wear of the fire proof furnace wall linings. The burners and the feed lines for injection gas into the shaft furnace are thus advantageously arranged in such a manner that the furnace experiences a thermal stress, which is as even as possible, across its entire periphery.

The quantity and/or the flow rate of the injection gas and/or of the injector blast and/or the power of the burners are advantageously controlled as a function of the temperature and/or of the CO (carbon monoxide)-content of the furnace gas, that is, of the combustion gases of the shaft furnace. Different coke quantities and different compositions of the starter, which is introduced into the shaft furnace and which is to be melted, impact the composition of the furnace gas. By analyzing the CO-content and/or the furnace gas temperature, conclusions can be drawn relating to the combustion process and to the melting process.

By varying the flow rate, the oxygen content and/or the quantity of the driving nozzle flow as well as the power of the burner or the burners, the melting process can always be adapted to the desired purpose. Additional parameters, which can be used to control the injection gas and/or the burner or burners, are the melting power, the furnace pressure and the exhaust gas analysis.

Advantageously, the control of the shaft furnace takes place as a function of one or several of the following parameters: temperature, composition or analysis of the furnace or exhaust gas, melting parameters, such as melting temperature, for example, furnace-specific data, composition or analysis of the slag removed from the shaft furnace, respectively.

Previously recorded operating data can hereby be used to optimally adjust the burner power and the oxygen supply to the furnace as a function of the current operating parameters and to attain a process, which corresponds to the technological requirements. Performance deviations can be identified and assigned rapidly. By storing the practical melting results, the furnace operating mode can be adapted historically in a self-correcting database. Quality influences relating to different coke starters, for example, are identified immediately.

According to the invention, a controlled quantity of oxygen is supplied to the shaft furnace for converting the solid fuel, for example the coke. This takes place in that the injection gas or gas mixture is supplied to the shaft furnace in a defined quantity and/or at a defined flow rate.

The invention as well as further details of the invention will be defined in more detail below by means of the exemplary embodiment illustrated in the drawing.

The FIGURE hereby shows a cupola furnace in cross section.

The FIGURE shows a cross section through a cupola furnace 1 for melting iron starter material. Several blast nozzles 2 are distributed around the periphery of the cupola furnace 1 in the known manner. In the shown embodiment, the blast nozzles 2 are alternately equipped with an oxygen driving nozzle 3 and an oxygen burner 4. Technically pure oxygen comprising a degree of purity of more than 95% is injected into the cupola furnace 1 via the oxygen driving nozzle 3. The driving nozzles 3 are connected to the air chamber, which is not illustrated in the FIGURE and from which air or wind, respectively, is sucked and is also blown into the cupola furnace 1 in response to the injection of the oxygen into the furnace 1. The oxygen burners 4 are operated with a fuel gas, preferably natural gas, and oxygen comprising a purity of more than 95%.

Advantageously, the oxygen-containing injection gas is accelerated in a driving nozzle and an injector blast is sucked in by means of the low pressure created in response to the acceleration of the injected gas and is combined with the injection gas to form a driving nozzle flow and is fed into the shaft furnace.

In this embodiment, the injection gas is fed into the shaft furnace at a high speed and can be blown far into the interior of the shaft furnace and can thus specifically impact the conversion of the coke. Additional oxygen is supplied to the shaft furnace via the injector blast. The injection gas escapes from the driving nozzle or from the driving nozzles at a high speed and thereby generates a low pressure, which, according to the invention, is used to suck in the injector blast. On the one hand, the sucked in quantity of injector blast is a function of the quantity and flow rate of the injection gas, but, on the other hand, can also advantageously be controlled separately. The mixture of accelerated injection gas and sucked-in injector blast forms a driving nozzle flow, which provides oxygen for the combustion process in the shaft furnace in a defined manner. Preferably, additional oxygen in the form of residual blast is supplied to the shaft furnace. As a general rule, pressurized air is available as residual blast.

In a preferred embodiment, the injector blast and the residual blast stem from the same source. For example, provision is thus made for a blast pipe, an air chamber or a blast device, which carries a certain quantity of hot blast, that is, hot air, which is under increased pressure. On the one hand, the injector blast pipe 6 is connected to this blast pipe and, on the other hand, the residual blast pipe 9. Accordingly, the entire available hot blast is divided into a portion, which is sucked in by the oxygen-containing gas via the injector blast pipe 6, and into a remaining residual blast, which is supplied to the shaft furnace via the residual blast pipe 9. Referring still to the FIGURE, the cupola furnace for melting a starting material includes a feed line 5 for an oxygen-containing infection gas at the downstream end of which a driving nozzle 3 is connected, an injector blast pipe 6 which empties into the feed line (as shown by the broken line) for the injection gas or into the driving nozzle 3, and at least one burner 4 provided with a feed line 7 for a gaseous oxidant and with a feed line 8 for a liquid fuel or a gaseous fuel.

It is also possible to provide for a separate supply for the injector blast and for the residual blast. For example, the shaft furnace can be provided with a first blast pipe, from which the injector blast is removed, and with a second blast pipe, from which the residual blast is removed. Even though the technical realization of this embodiment is more extensive than the above-described embodiment comprising a common blast pipe and its feed line 10 for residual blast and injector blast, the pressure and temperature ratios for injector blast and residual blast can, on the other hand, be adjusted independent of one another by means of separate blast pipes or blast devices, thus creating additional degrees of freedom for controlling the combustion process in the shaft furnace. Air, which has been sucked in directly from the surroundings, can furthermore be used as injector blast. It is also possible to suck in other gases or substances with the injection gas and to supply them to the combustion in the shaft furnace.

Preferably, an injection gas comprising an oxygen content of more than 90%, preferably of more than 95%, particularly preferably of more than 99%, is used. However, oxygen-enriched air can also be used as injection gas. Preferably, the injection gas is injected into the shaft furnace at a high speed of from 100 to 280 m/s, for example.

Preferably, the feed line for the injection gas 5 is connected to a supply device, for example a tank, for technically pure oxygen. A defined quantity of air can be added to the technically pure oxygen via the injector blast pipe 6, so as to adjust the oxygen content in the resulting mixture of oxygen and air. This mixture is accelerated in the driving nozzle, preferably a convergent-divergent nozzle, and is introduced into the shaft furnace as driving nozzle flow.

Particularly preferably, the oxygen content of the driving nozzle flow resulting from the combination of injection gas an injector blast is chosen to be between 25% and 65%. An additional parameter, via which the combustion of the fossil fuel can be controlled, is available via the oxygen content of the driving nozzle flow. By increasing the oxygen content, for example, the combustion can thus be intensified, that is, the temperature of the combustion gas is increased and more fossil fuel is combusted per time unit.

For example, technical oxygen is inserted into a special driving nozzle chamber via convergent-divergent nozzles. A preliminarily released portion of the primary blast quantity is sucked in as injector blast portion in a controlled manner via the resulting low pressure. The adjustment of the injector blast portion via a control flap leads to different oxygen enrichments and correspondingly high escape speeds into the melting zone. The remaining residual primary blast reaches into the area of the melting zone in a considerably smaller quantity and at a lower speed.

Preferably, coke is used as solid fuel. In practice, the quality of the coke varies highly, whereby it becomes necessary periodically to retrace and adapt the combustion parameters so as to attain an optimal conversion of the coke and thus an optimal melting process. With the use of the burner according to the invention, fluctuations in the coke quality can be easily compensated.

The burners are preferably operated with oxygen comprising a purity of more than 90%, preferably of more than 95%, particularly preferably of more than 99%, as oxidant.

The power of the burners can be varied, depending on the process conditions. Preferably, the burner power is adjusted such that it is between 10% and 50% of the entire energy, which is supplied to the shaft furnace.

In a particularly preferred embodiment, provision is made in the shaft furnace for several, preferably four to ten blast nozzles, which are evenly distributed across the periphery of the shaft furnace and which are alternately provided in a burner or in a lance or nozzle, respectively, for supplying the injection gas. The term "blast nozzles" hereby refers to openings in the walls of the shaft furnace, which typically serve the purpose of feeding wind or air into the melting chamber, but which, according to the invention, can also be equipped with burners.

In a particularly preferred embodiment, the nozzles for the injection gas are embodied as driving nozzles, in which, as is explained above, the injection gas is accelerated and an injector blast is sucked in by means of the low pressure, which is generated in response to the acceleration of the injector gas.

The combination of oxygen injection and burners in a cupola furnace according to the invention has numerous advantages as compared to the previously used methods. The combustion of the solid fossil fuel is improved considerably and less fuel is required. The emissions or immissions, respectively, are reduced considerably. Quality fluctuations of the fuel, in particular different coke qualities, can be accommodated. The combustion of the solid fuel can be controlled better and the stoichiometry in the shaft furnace can be adjusted in a defined manner. The invention makes it possible to specifically influence the melting process of shaft furnaces and cupola furnace systems. The degrees of efficiency and environmental results are improved considerably. The combination of oxygen injection and oxygen burners according to the invention makes it possible to supply more oxygen to the shaft furnace and, at the same time, to have to use less coke.

The technology according to the invention makes it possible to use more oxygen for melting, without the appearance of the disadvantages known from the state of the art, such as lower carbonization or drop of the iron temperature. It became evident that the oxygen quantity of 20 to 40 $Nm^3/t_{Fe}$, which is processed for each produced ton of iron, can be increased to 20 to 80 $Nm^3/t_{Fe}$.

What is claimed is:

1. A method for operating a shaft furnace for melting starting material, comprising heating the shaft furnace by combustion of a solid fuel, injecting an injection gas having an oxygen portion of more than 21% into the shaft furnace, accelerating the injection gas in a driving nozzle and sucking an injector blast into the shaft furnace by low pressure created in response to the accelerating injection gas for combining the injector blast with the injection gas to form a driving nozzle flow fed into the shaft furnace, heating the shaft furnace by at least one burner, and supplying a fuel selected from the group consisting of a gaseous fuel and a liquid fuel, and a gaseous oxidant comprising an oxygen portion of more than 21%, to the at least one burner.

2. The method according to claim 1, further comprising supplying a residual blast to the shaft furnace.

3. The method according to claim 2, comprising removing the injector blast and the residual blast from a common blast pipe.

4. The method according to one of claim 1, wherein the injection gas comprises oxygen having a purity of more than 90%.

5. The method according to claim 1, wherein the solid fuel comprises coke.

6. The method according to claim 1, wherein the oxygen portion comprises a purity of more than 90% and is used as oxidant.

7. The method according to claim 1, further comprising supplying between 10% and 50% of total energy to the shaft furnace via the at least one burner.

8. The method according to claim 1, wherein the shaft furnace comprises a cupola furnace.

* * * * *